US006848371B2

(12) United States Patent
Zheng

(10) Patent No.: US 6,848,371 B2
(45) Date of Patent: Feb. 1, 2005

(54) ERECTABLE SHELVING STRUCTURE

(75) Inventor: Xiaoyu Zheng, Bronx, NY (US)

(73) Assignee: Arrow Art Finishers, L.L.C., Princeton, NJ (US)

( * ) Notice: Subject to any disclaimer, the term of this patent is extended or adjusted under 35 U.S.C. 154(b) by 86 days.

(21) Appl. No.: 10/289,959

(22) Filed: Nov. 7, 2002

(65) Prior Publication Data

US 2004/0089208 A1 May 13, 2004

(51) Int. Cl.[7] ..... A47B 43/02
(52) U.S. Cl. ..... 108/165; 108/171; 108/167
(58) Field of Search ..... 108/171, 165, 108/173, 174, 167, 169, 162, 115, 168, 166, 172; 211/135, 149

(56) References Cited

U.S. PATENT DOCUMENTS

| | | | | | |
|---|---|---|---|---|---|
| 4,311,100 | A | * | 1/1982 | Gardner et al. | 108/165 |
| 4,437,413 | A | * | 3/1984 | O'Brian et al. | 108/162 |
| 4,854,246 | A | * | 8/1989 | Belokin et al. | 108/162 |
| 4,942,830 | A | * | 7/1990 | Macaluso et al. | 108/162 |
| 5,273,169 | A | * | 12/1993 | Maglione | 211/149 |
| 5,315,936 | A | * | 5/1994 | Smith | 108/165 |
| 5,392,902 | A | * | 2/1995 | Vlastakis | 211/135 |
| 5,465,851 | A | * | 11/1995 | Smith | 211/59.1 |
| 5,501,158 | A | * | 3/1996 | Cheney | 108/165 |
| 6,612,669 | B2 | * | 9/2003 | Grueneberg | 312/259 |

* cited by examiner

*Primary Examiner*—Jose V. Chen
(74) *Attorney, Agent, or Firm*—Kirschstein, et al.

(57) ABSTRACT

Shelves in a collapsible shelving structure are foldable about respective fold lines extending widthwise of respective shelves to load-bearing states.

11 Claims, 2 Drawing Sheets

ERECTABLE SHELVING STRUCTURE

BACKGROUND OF THE INVENTION

1. Field of the Invention

The present invention generally relates to erectable shelving structures constituted of a corrugated board material.

2. Description of the Related Art

Shelving structures that are movable from a collapsed position to an erected position are know. For example, U.S. Pat. No. 5,315,936 discloses a shelving structure wherein the movement of vertical side panels causes individual shelves to deploy to a load-supporting, generally horizontal state.

As advantageous as some of these known shelving structures are, they still occupy a relatively large amount of space, because each shelf is not foldable about a fold line extending across its width. Such a fold line tends to weaken the shelf and detracts from its load-supporting function. Instead, as disclosed in the aforementioned patent, each shelf is not foldable widthwise, but instead is lowered into position by being pivoted along a rear edge extending lengthwise of the shelf.

SUMMARY OF THE INVENTION

Objects of the Invention

Accordingly, one object of this invention is to advance the state of the art of erectable shelving structures.

Another object of this invention is to provide an erectable shelving structure having a plurality of shelves which are simultaneously moved to respective load-bearing states in a simple, convenient manner.

Still another object of this invention is to reduce the amount of space occupied by a collapsed shelving structure.

Yet another object of this invention is to fold shelves widthwise without compromising the structural strength of the shelves to bear loads.

FEATURES OF THE INVENTION

In keeping with these objects and others which will be apparent hereinafter, one feature of this invention resides, briefly stated, in a shelving structure comprising a pair of side walls, and at least one foldable shelf having opposite end regions hinged to the side walls. The side walls are movable toward and away from each other along a longitudinal axis between a collapsed position and an erected position. During this movement, each shelf is unfolded along a fold line extending transversely of the longitudinal axis from a folded state to an unfolded, load-supporting state. The fold line is midway between the opposite end regions of a respective shelf, and is midway between the side walls.

In accordance with this invention, each shelf has an upper shelf wall and a lower shelf wall. The upper shelf wall has a non-linear slit extending therethrough, and upper projections extending in opposite directions along the longitudinal axis across and past the fold line. The fold line is provided on the lower shelf wall and, more particularly, on an outer liner glued to a middle fluted layer where, in the preferred embodiment, the shelves, as well as the side walls, are constituted of a corrugated board material.

The middle fluted layer also has a non-linear slit extending therethrough, and lower projections extending in opposite directions along the longitudinal axis across and past the fold line. The lower projections alternate with the upper projections along the fold line. The upper projections abut against the lower projections to hold each shelf in the load-bearing state in which the shelf extends in a plane along the longitudinal axis between the side walls in the erected position.

The provision of a fold line transversely of the shelf does not compromise the strength thereof, because of the locking engagement between the upper and lower projections. Thus, the structure in its collapsed position, in which the side walls overlie and sandwich the folded-up shelves therebetween, is compact and occupies relatively little space.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 2:
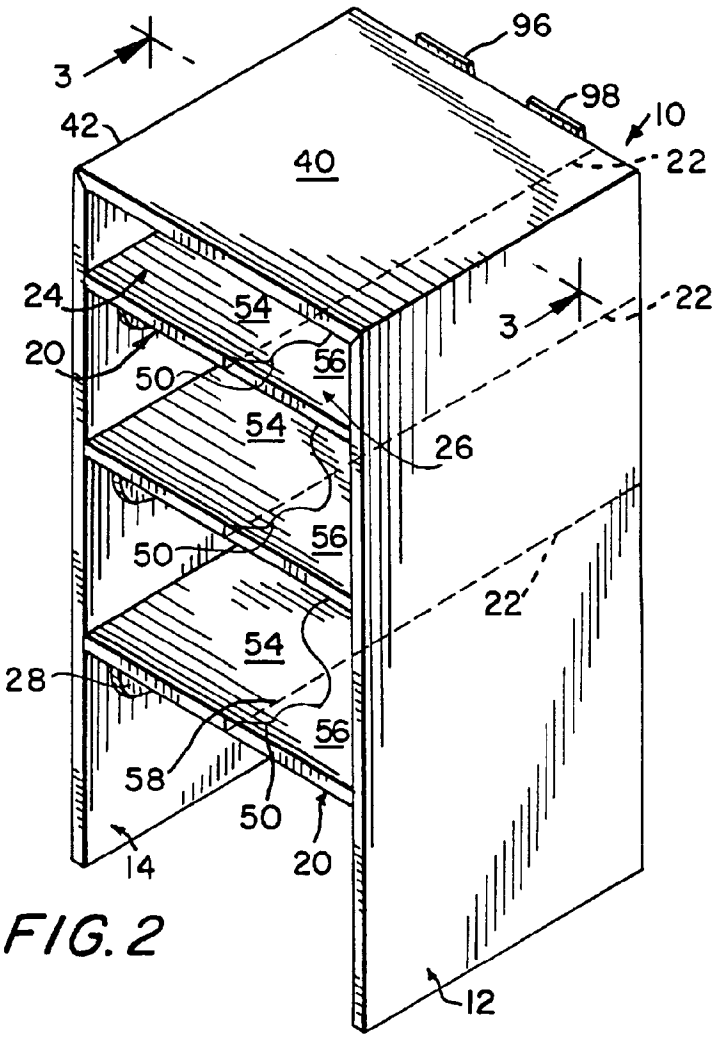
FIG. 2 is a perspective view of the structure of FIG. 1 in the erected position.
Figure 1:
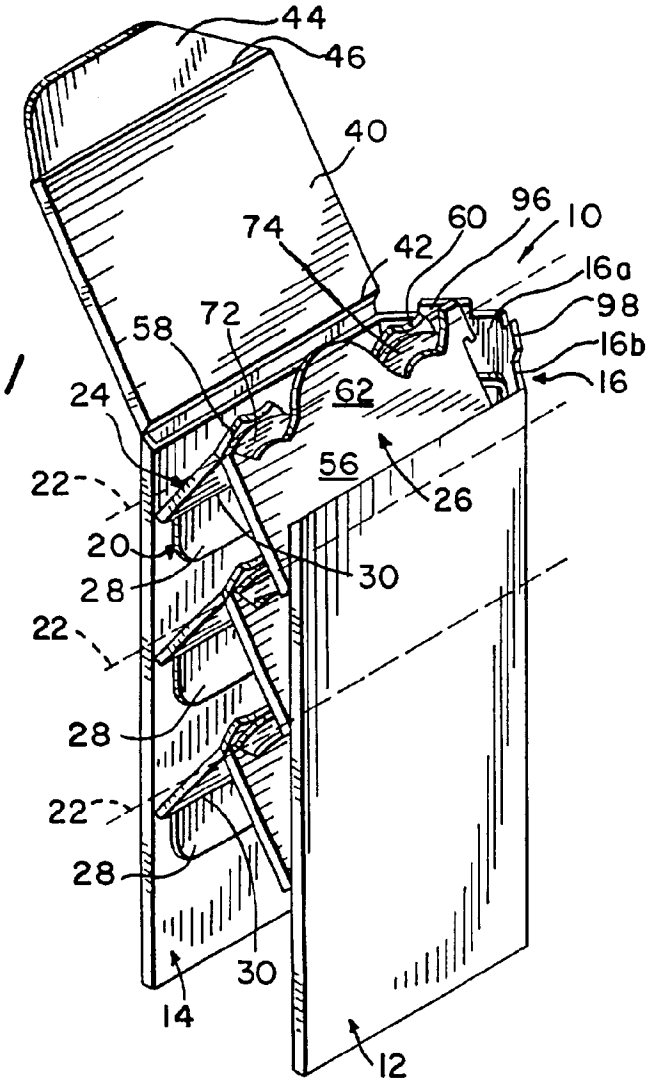
FIG. 1 is a perspective view of a shelving structure in a position midway between its collapsed and erected positions.

Referring now to the drawings, reference numeral 10 identifies a shelving structure which is shown in an erected position in FIG. 2 and in a partially collapsed position in FIG. 1. Structure 10 includes a pair of side walls 12, 14 of corrugated board material. Each side wall is a double wall and includes outer walls 12*a*, 14*a* and inner walls 12*b*, 14*b*. Structure 10 also includes a rear wall 16 of corrugated board material and having rear wall portions 16*a*, 16*b* foldable about a vertical upright axis 18.

Figure 3:
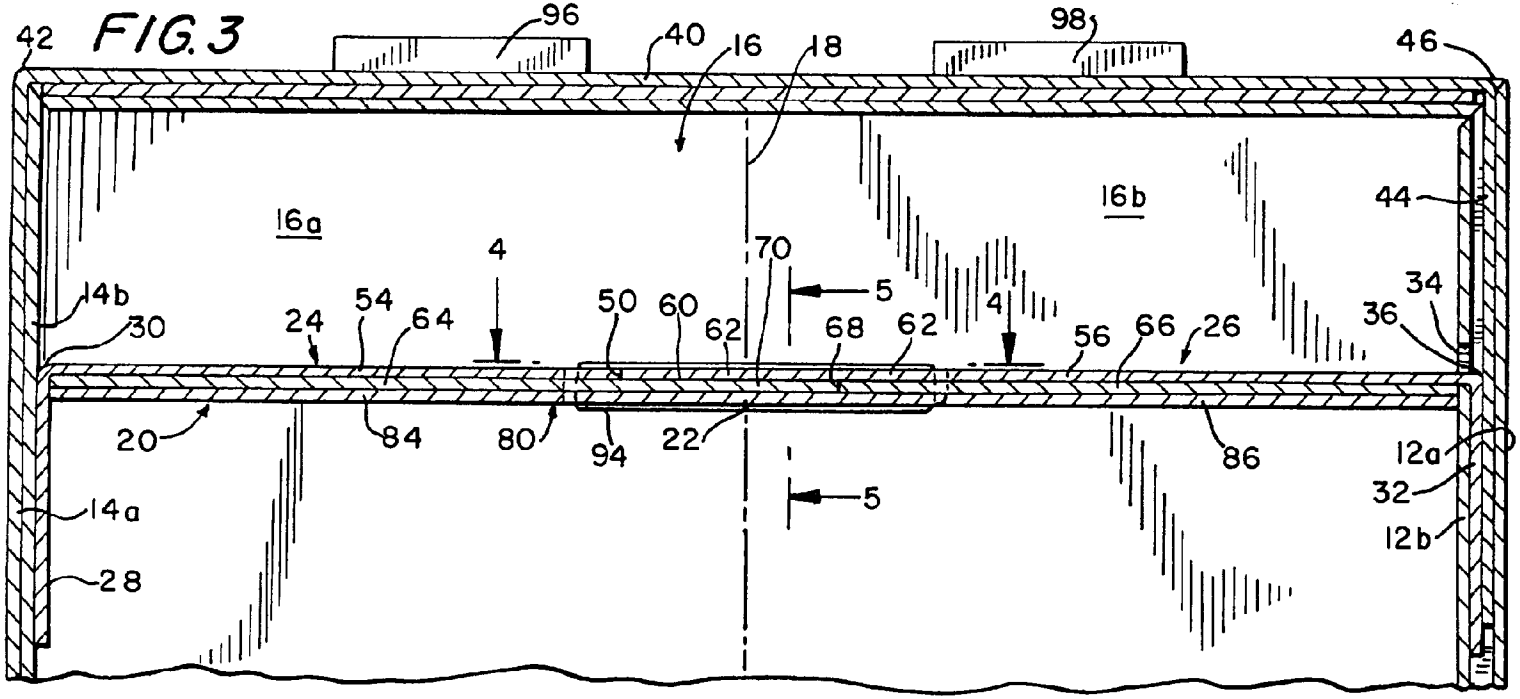
FIG. 3 is an enlarged, sectional view taken on line 3—3 of FIG. 2.
Figure 5:
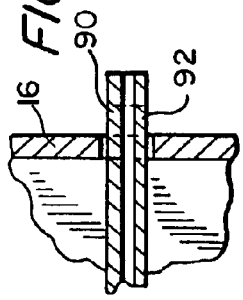
FIG. 5 is an enlarged, sectional view taken on line 5—5 of FIG. 3.
Figure 4:
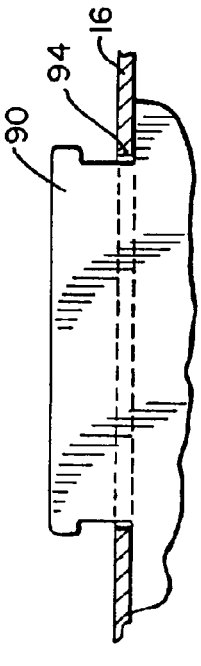
FIG. 4 is an enlarged, sectional view taken on line 4—4 of FIG. 3.

Structure 10 still further includes a plurality of shelves 20 arranged at different elevations along the upright axis 18. Each shelf is made of corrugated board material and is foldable about a fold line 22, as explained in detail below. Each shelf has a first shelf section 24 and a second shelf section 26 both foldable about the fold line 22. First section 24 has a hinge flap 28 at its outer end region adhered to inner wall 14*b* (see FIG. 3) and pivotable about linear edge 30. Second section 26 has a hinge flap 32 inserted into a cutout 34 in the inner wall 12*b* (see FIG. 3) and positioned in a space between the inner and outer walls 12*b*, 12*a*. Second section 26 is pivotable about linear edge 36.

Thus, as seen in FIG. 2, the side walls 12, 14 are positioned apart from each other in the erected position at a predetermined distance, that is, the length of each shelf. Each shelf has its sections 24, 26 co-planar in a load-bearing state. The rear wall 16 is planar. Also shown is a top wall 40 hinged along linear edge 42 to the outer wall 14*a*, and having a top flap 44 hinged along linear edge 46 and inserted into the space between the inner and outer walls 12*b*, 12*a*.

In order to collapse the structure, the top flap 44 is removed from its position between the walls 12*b*, 12*a*, and the side walls 12, 14 are brought closer together, as shown in FIG. 1. Each shelf section 24, 26 folds about its respective fold line 22 which extends along the entire width of the shelf. In the fully collapsed position, each shelf section 24, 26 touches each other, and the side walls touch the shelf sections. The top wall 40 is folded back to overlie the side wall 14.

Each shelf 20 has upper shelf wall portions 54, 56 separated by a non-linear slit 50 extending therethrough. The slit 50 is curvilinear, and wall portion 54 is formed with upper projections 58, 60. Wall portion 56 is formed with upper projection 62 located between the projections 58, 60. In the erected position, the projection 62 nests closely between the projections 58, 60 and, indeed, the adjacent edges of wall portions 54, 56 are of complementary interfitting contour. It will also be noted that projections 58, 60 longitudinally extend in one direction across and past the respective fold line, and that projection 62 likewise longitudinally extends across and past the fold line, but in an opposite direction.

Each shelf 20 has lower shelf wall portions 64, 66 (see FIG. 3) directly underneath the upper shelf wall portions 54, 56 and separated by a non-linear slit 68. The slit 68 is preferably curvilinear, and wall portion 64 has a lower projection 70, and wall portion 66 has a pair of lower projections 72, 74 between which the projection 70 nests closely in the load-bearing state of the shelf. Lower projection 70 lies underneath upper projection 62, and the projections 62, 70 extend in opposite directions across and past the fold line. Lower projections 72, 74 lie underneath upper projections 58, 60, and each such pair of projections extends in opposite directions across and past the fold line.

Each shelf also has a base layer 80 glued to the underside of the lower shelf wall portions 64, 66. The base layer 80 is not slit like the upper shelf wall portions 54, 56 or the lower shelf wall portions 64, 66. Instead, the base layer has base portions 84, 86 which are foldable about the fold line 22, which is a crease extending linearly along the entire width of the shelf. The base layer 80 supports the upper and lower shelf wall portions from below. Preferably, the base layer is a corrugated board material having a fluted layer and an outer liner. The fluted layer may be slit, but the slit does not extend through the outer liner.

For increased rigidity, the rear edge of each shelf has upper and lower tabs 90, 92 integral with the upper shelf wall portions 54, 56 and with the base layer 80. The juxtaposed tabs 90, 92 are inserted into a locking hole 94 extending through the rear wall 16 and aid in supporting the shelf at its weakest region, i.e., at its center and on the fold line 22. A pair of upstanding tabs 96, 98 on an upper edge of the rear wall 16 assists in enabling another shelving structure to be stacked on top of the structure 10.

It will be understood that each of the elements described above, or two or more together, also may find a useful application in other types of constructions differing from the types described above.

While the invention has been illustrated and described as embodied in an erectable shelving structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A shelving structure, comprising:

a) a pair of side walls movable toward and away from each other along a longitudinal axis between a collapsed position and an erected position, one of the side walls having a pair of walls bounding a space;

b) a foldable shelf having opposite end regions hinged to the side walls, an upper shelf wall having a non-linear slit extending therethrough, and a lower shelf wall having a fold line about which the shelf folds during movement of the side walls to the erected position, the fold line extending transversely of the longitudinal axis, the upper shelf wall having upper projections extending in opposite directions along the longitudinal axis across and past the fold line, the projections abutting against the lower shelf wall to hold the shelf in a load-supporting state in which the shelf extends in a plane along the longitudinal axis between the side walls in the erected position; and c) a top locking flap hinged to the other of the side walls and inserted into the space for interlocking the side walls in the erected position.

2. The structure of claim 1, wherein each side wall is a double-walled material extending in a plane perpendicular to the plane of the shelf in the load-supporting state.

3. The structure of claim 1, and further comprising a rear wall extending along the longitudinal axis between, and hinged to, the side walls, the rear wall having a fold midway between the side walls in the erected position.

4. The structure of claim 1, and further comprising an additional foldable shelf having opposite end regions hinged to the side walls at a different elevation as compared to the first-mentioned shelf.

5. The structure of claim 1, wherein the lower shelf wail has lower projections extending in opposite directions along the longitudinal axis across and past the fold line, and wherein the upper projections alternate with the lower projections in a direction along the fold line.

6. The structure of claim 1, wherein the non-linear slit is curvilinear and wherein the upper projections are curved.

7. The structure of claim 1, wherein each side wall and the shelf are constituted of a corrugated board material.

8. A shelving structure, comprising:

a) a pair of side walls movable toward and away from each other along a longitudinal axis between a collapsed position and an erected position;

b) a rear wall extending along the longitudinal axis between, and hinged to, the side walls, the rear wall being foldable along an upright axis between a collapsed state and an erected state during movement of the side walls; and c) a plurality of foldable shelves at different elevations along the upright axis, each shelf having opposite end regions hinged to the side walls, an upper shelf wall having a first non-linear slit extending therethrough, and a lower shelf wall having a fluted middle layer having a non-linear slit extending therethrough and an outer liner glued to the fluted middle layer, the outer liner having a fold line about which the respective shelf folds during movement of the side walls, each fold line extending transversely of the longitudinal axis, each fold line and the upright axis lying in the same upright plane, the upper shelf wall having upper projections extending in opposite directions along the longitudinal axis across and past each fold line, the fluted middle layer having lower projections extending in opposite directions along the longitudinal axis across and past each fold line, the upper projections alternating with the lower projections along the fold line, the upper projections extending in one direction along the longitudinal axis abutting against the lower projections extending in an opposite direction along the longitudinal axis to hold each shelf in a load-supporting state in which the respective shelf extends in a plane along the longitudinal axis between the side walls in the erected position.

9. A shelving structure, comprising:

a) a pair of side walls movable toward and away from each other along a longitudinal axis between a collapsed position and an erected position;

b) a foldable shelf having a locking tab and opposite end regions hinged to the side walls, an upper shelf wall having a non-linear slit extending therethrough, and a lower shelf wall having a fold line about which the shelf folds during movement of the side walls to the erected position, the fold line extending transversely of the longitudinal axis, the upper shelf wall having upper projections extending in opposite directions along the longitudinal axis across and past the fold line, the projections abutting against the lower shelf wall to hold the shelf in a load-supporting state in which the shelf extends in a plane along the longitudinal axis between the side walls in the erected position; and c) a rear wall extending along the longitudinal axis between, and hinged to, the side walls, the rear wall having a fold line midway between the side walls in the erected position and a locking slot for receiving the locking tab in the erected position.

10. A shelving structure, comprising:

a) a pair of side walls movable toward and away from each other along a longitudinal axis between a collapsed position and an erected position; and b) a foldable shelf having opposite end regions hinged to the side walls, an upper shelf wall having a non-linear slit extending therethrough, and a lower shelf wall having a fold line about which the shelf folds during movement of the side walls to the erected position, the fold line extending transversely of the longitudinal axis, the upper shelf wall having upper projections extending in opposite directions along the longitudinal axis across and past the fold line, the projections abutting against the lower shelf wall to hold the shelf in a load-supporting state in which the shelf extends in a plane along the longitudinal axis between the side walls in the erected position, the lower shelf wall also having lower projections extending in opposite directions along the longitudinal axis across and past the fold line, and the upper projections alternating with the lower projections in a direction along the fold line, the shelf being constituted of a corrugated board having a fluted middle layer which has a non-linear slit extending therethrough, and an outer liner glued to the fluted layer, the fold line being on the outer liner.

11. The structure of claim 10, wherein the fluted middle layer of the lower shelf has a non-linear slit extending therethrough.

* * * * *